US005588741A

United States Patent [19]

Huang

[11] Patent Number: 5,588,741

[45] Date of Patent: Dec. 31, 1996

[54] LAMP HOLDER ASSEMBLY

[76] Inventor: Angus Huang, 7F, No. 15, Alley 17, Lane 79, Sec. 2, Kee-Lung Rd., Taipei, Taiwan

[21] Appl. No.: 542,502

[22] Filed: Oct. 13, 1995

[51] Int. Cl.[6] ..... F21V 31/02

[52] U.S. Cl. ..... 362/267; 362/417; 362/438; 362/439; 174/65 R

[58] Field of Search ..... 174/65 R, 65 G, 174/152 G, 153 R, 153 G; 362/257, 267, 311, 351, 378, 396, 416, 417, 437, 438, 439, 443, 448, 457

[56] References Cited

U.S. PATENT DOCUMENTS

| | | | |
|---|---|---|---|
| 1,628,863 | 5/1927 | Townsend | 362/437 |
| 1,733,277 | 10/1929 | Sawin | 362/437 |
| 1,760,618 | 5/1930 | Woodhead | 174/152 G |
| 1,940,429 | 12/1933 | McKay | 362/437 |
| 1,959,143 | 5/1934 | Watral | 362/437 |
| 4,426,677 | 1/1984 | Dennis | 362/438 |
| 4,504,888 | 3/1985 | Rosenthal | 362/417 |

*Primary Examiner*—Stephen F. Husar
*Assistant Examiner*—Alan B. Cariaso
*Attorney, Agent, or Firm*—Donald C. Casey

[57] ABSTRACT

A lamp holder assembly including an upper shell and a bottom shell connected together by a screw joint to hold a lampshade on the outside and a ceramic socket on the inside, an electric wire inserted through the upper shell and connected to the ceramic socket for the transmission of power supply to the ceramic socket, a wire holder mounted in a cylindrical top section of the upper shell and screwed up with a plastic screw cap to hold the electric wire, and two screws respectively threaded into two opposite screw holes on the cylindrical top section of the upper shell and stopped against the electric wire at two opposite sides to hold down the electric wire and to secure a hanger to the upper shell.

3 Claims, 3 Drawing Sheets

LAMP HOLDER ASSEMBLY

BACKGROUND OF THE INVENTION

The present invention relates to lamp holders, and relates more particularly to a lamp holder assembly which securely holds the electric wire in place and, effectively prohibits outside moisture from entering to the inside.

In stall-barn systems, dairy barns, cow barns, etc., lamps are commonly used for giving heat to keep the temperature of the barns within the desired range. Regular lamps for this purpose are commonly comprised of a lamp holder, a ceramic socket fastened to the lamp holder to hold the bulb, an electric wire connected to the ceramic socket for connection to power supply, and a lampshade mounted around the lamp holder. This structure of lamp is still not satisfactory in function. Because the conductors of the electric wire are fixed in place simply by screws, the electric wire tends to be disconnected from the ceramic socket when it is stretched. Another drawback of this structure of lamp is that the insulator of the electric wire tends to be damaged by the sharp edge of the wire entrance of the lamp holder. Still another drawback of this structure of lamp is that water drops tend to pass through gaps between the parts of the lamp during the washing of the barn with water, causing an electric leakage. Furthermore, the installation of this structure of lamp is complicated.

SUMMARY OF THE INVENTION

The present invention has been accomplished to provide a lamp holder assembly which eliminates the aforesaid drawbacks.

According to one aspect of the present invention, the lamp holder assembly comprises an upper shell, a hanger connected to the upper shell, an electric wire, a wire holder mounted on the upper shell to hold the electric wire, a ceramic socket fixed to the inside of the upper shell and connected to the electric wire to hold a lamp bulb, a bottom shell mounted around the ceramic socket and fixed to the upper shell, and a lampshade retained between the upper shell and the bottom shell around the lamp bulb, wherein: the upper shell is made of hollow, cap-like structure, comprising an outward flange around the periphery of a bottom end thereof, an inner thread, a cylindrical top section, which holds the wire holder, two screw holes on the cylindrical top section at two opposite sides, and two screws respectively threaded into the screw holes and stopped against the electric wire at two opposite sides to secure the hanger in place and to hold down the electric wire; the bottom shell is made of cylindrical shape fitting the upper shell, having an outer thread threaded into the inner thread of the upper shell, an outward flange attached to the outward flange of the upper shell to hold a top side of the lampshade between, and a center through hole, which receives the ceramic socket. According to another aspect of the present invention, the wire holder is screwed up with a screw cap, which is molded from flexible plastics and prohibits outside moisture from entering the wire holder. According to still another aspect of the present invention, water seal rings are respectively mounted around the screws to stop outside moisture from passing the screw holes into the inside of the upper shell.

DETAILED DESCRIPTION OF THE PREFERRED EMBODIMENT

Figure 1:
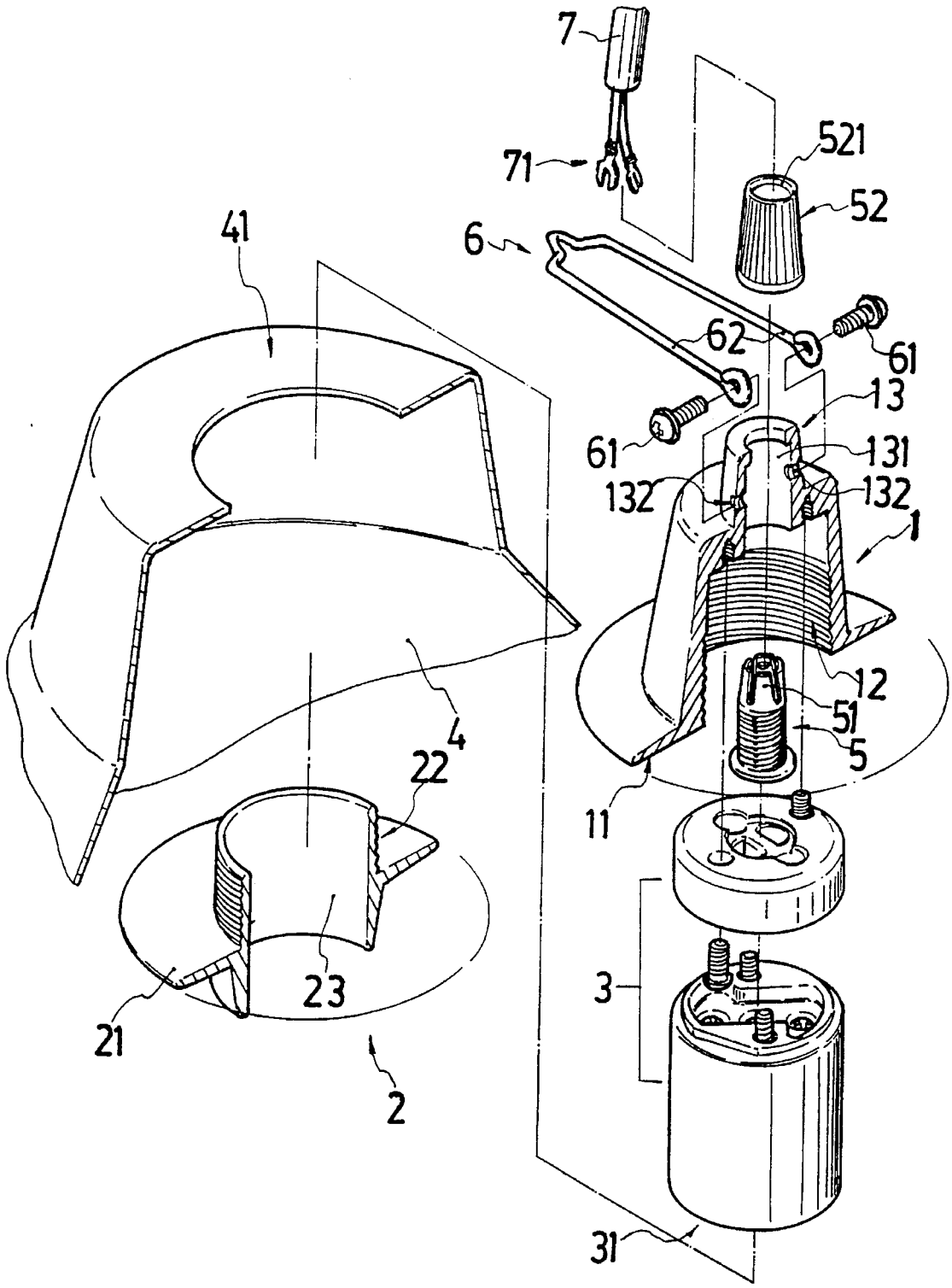
FIG. 1 is an exploded perspective view of a lamp holder assembly according to the present invention.
Figure 2:
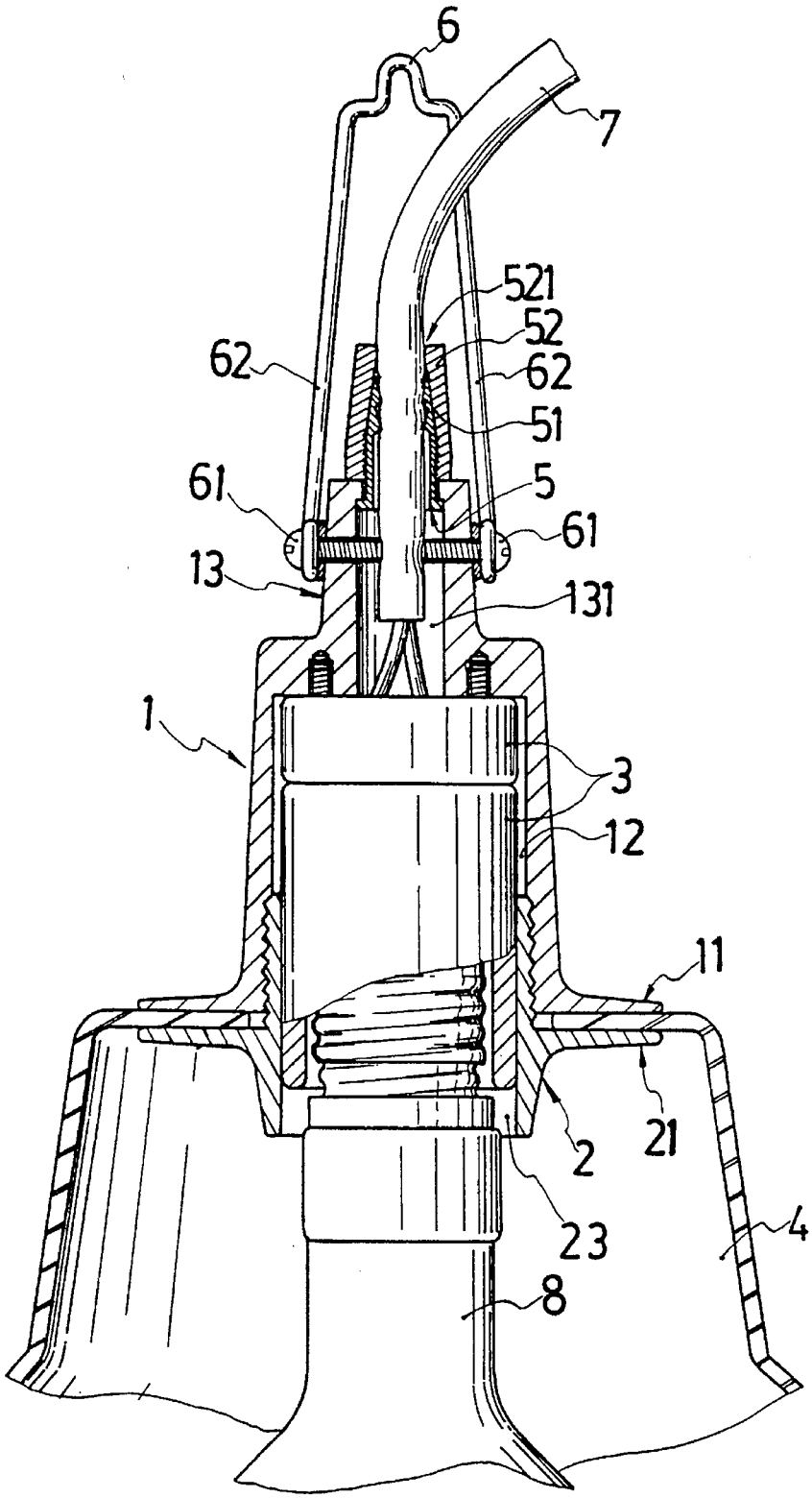
FIG. 2 is a sectional assembly view of the lamp holder assembly shown in FIG. 1.

Referring to FIGS. 1 and 2, the lamp holder assembly in accordance with the present invention is generally comprised of an upper shell, 1, a bottom shell 2, a ceramic socket 3 mounted inside the upper shell 1 and the bottom shell 2 for holding a lamp bulb 8, a lampshade 4, an electric wire 7, a wire holder 5 for holding the electric wire 7, and a hanger 6. The upper shell 1 is made of hollow, cap-like structure from aluminum alloy by casting, having an outward flange 11 around the bottom end for pressing on the top side 41 of the lampshade 4, an inner thread 12 for mounting the bottom shell 2, a cylindrical top section 13, a longitudinal space 131 defined within the cylindrical top section 13 for mounting the wire holder 5, and two screw holes 132 on the cylindrical top section 13 at two opposite sides. The hanger 6 has two opposite ends 62 respectively connected to the screw holes 132 by a respective screw 61. The bottom shell 2 is made of cylindrical shape fitting the upper shell 1, having an outer thread 22 threaded into the inner thread 12 of the upper shell 1, an outward flange 21 attached to the outward flange 11 of the upper shell 1 to hold the top side 41 of the lampshade 4 between, and a center through hole 23 for receiving the ceramic socket 3. The ceramic socket 3 is fixedly secured to the inside of the upper shell 1 and received inside the center through hole 23 of the bottom shell 2, and connected to the electric wire 7. When the lamp bulb 8 is threaded into the threaded bottom end 31 of the ceramic socket 3, the ring contact and tip contact of the lamp bulb 8 are respectively connected to the two opposite terminals 71 of the electric wire 7 through a respective contact (not shown) inside the ceramic socket 3.

Referring to FIGS. 1 and 2 again, the cylindrical wire holder 5 is externally threaded, and made of cylindrical shape having a split top end 51. When the cylindrical wire holder 5 is mounted in the longitudinal space 131 of the cylindrical top section 13 of the upper shell 1, the two terminals 71 of the electric wire 7 are inserted through the center through hole 521 of a screw cap 52 and the cylindrical wire holder 5 and then connected to the ceramic socket 3, then the screw cap 52 is threaded onto the externally threaded, cylindrical wire holder 5 to compress the split top end 51 of the cylindrical wire holder 5 inwards, and therefor the electric wire 7 is firmly retained to the wire holder 5. When the electric wire 7 is installed, the screws 61 are screwed tight and stopped against the electric wire 7 at two opposite sides. Therefore, the electric wire 7 will not be disconnected from the ceramic socket 3 when it is stretched. The screw cap 52 is preferably molded from flexible plastics. The diameter of the orifice at the top end of the center through hole 521 of the screw cap 52 is preferably slightly smaller than that of the electric wire 7 so that moisture is prohibited from entering the screw cap 52 when the screw cap 52 is threaded onto the cylindrical wire holder 5. Water seal rings may be used and mounted around the electric wire 7 and the screws 61 to stop moisture from entering the screw cap 52 and the upper shell 1.

Figure 3:
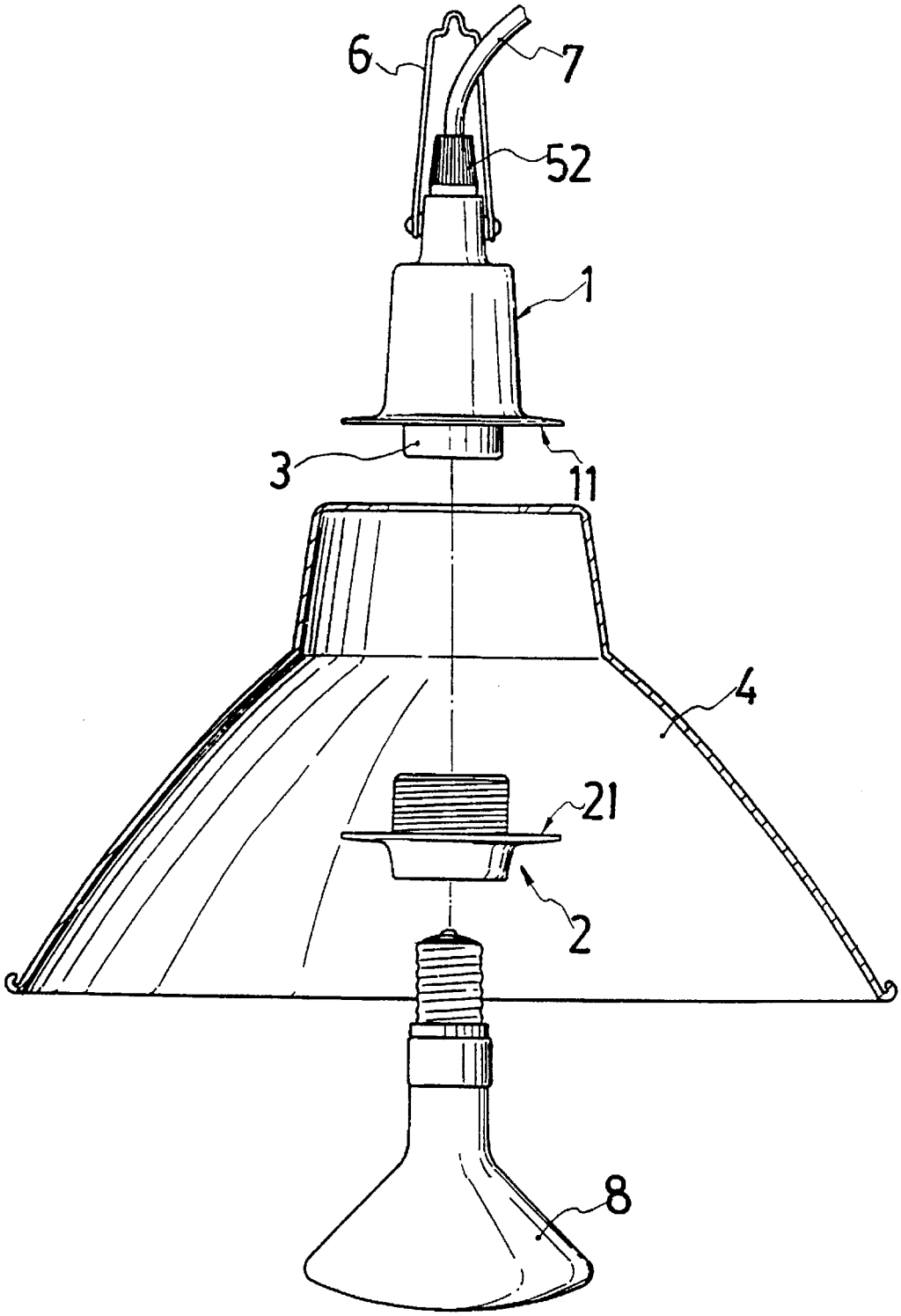
FIG. 3 is a plain view of the lamp holder assembly shown in FIG. 1.

Referring to FIG. 3, the upper shell 1, the ceramic socket 3, the electric wire 7, the hanger 6, and the wire holder 5 are fastened together and packed in one unit; the lampshade 4, the bottom shell 2, and the lamp bulb 8 are of separated devices. These packing arrangement permits the consumer to install the lamp holder assembly quickly.

It is to be understood that the drawings are designed for purposes of illustration only, and are not intended as a definition of the limits and scope of the invention disclosed.

What is claimed is:

1. A lamp holder assembly comprising an upper shell, a hanger connected to said upper shell, an electric wire, a wire holder mounted on said upper shell to hold said electric wire, a ceramic socket fixed to the inside of said upper shell and connected to said electric wire to hold a lamp bulb, a bottom shell mounted around said ceramic socket and fixed to said upper shell, and a lampshade retained between said upper shell and said bottom shell around the lamp bulb, wherein: said upper shell is made of hollow, cap-like structure, comprising an outward flange around the periphery of a bottom end thereof, an inner thread, a cylindrical top section, which holds said wire holder, two screw holes on said cylindrical top section at two opposite sides, and two screws respectively threaded into said screw holes and stopped against said electric wire at two opposite sides to secure said hanger in place and to hold down said electric wire; said bottom shell is made of cylindrical shape fitting said upper shell, having an outer thread threaded into the inner thread of said upper shell, an outward flange attached to the outward flange of said upper shell to hold a top side of said lampshade between, and a center through hole, which receives said ceramic socket.

2. The lamp holder assembly of claim 1 wherein said wire holder comprises an externally threaded cylindrical body partially extended out of the cylindrical top section of said upper shell and mounted around said electric wire, said externally threaded cylindrical body having a split top end disposed outside said upper shell, and a screw cap mounted around said electric wire and threaded onto said externally threaded cylindrical body to compress said split top end against the periphery of said electric wire, said screw cap having a top orifice closely engaged with the periphery of said electric wire to stop outside moisture from passing to the inside of said wire holder.

3. The lamp holder assembly of claim 1 wherein said upper shell further comprises two water seal rings respectively mounted around said screws to stop moisture from passing through said screw holes.

* * * * *